US005322618A

United States Patent [19]

Raterman

[11] Patent Number: 5,322,618

[45] Date of Patent: Jun. 21, 1994

[54] FCC PROCESS WITH SCANNED RISER

[75] Inventor: Michael F. Raterman, Doylestown, Pa.

[73] Assignee: Mobil Oil Corporation, Fairfax, Va.

[21] Appl. No.: 59,220

[22] Filed: May 10, 1993

[51] Int. Cl.[5] ..... C10G 11/18; C10G 35/14

[52] U.S. Cl. ..... 208/113; 208/153; 208/DIG. 1

[58] Field of Search ..... 208/113, DIG. 1, 153

[56] References Cited

U.S. PATENT DOCUMENTS

| | | | |
|---|---|---|---|
| 4,532,026 | 7/1985 | Fries | 208/DIG. 1 |
| 4,650,566 | 3/1987 | Buyan et al. | 208/DIG. 1 |
| 4,808,383 | 2/1989 | Buyan et al. | 422/140 |

OTHER PUBLICATIONS

Bartholomew, et al. "Measuring Solids Concentration in Fluidized Systems by Gamma-Ray Absorption," *Industrial and Engineering Chemistry*, vol. 49, No. 3, Mar. 1957, pp. 428–431.

*Primary Examiner*—R. Bruce Breneman
*Assistant Examiner*—Lorna M. Douyon
*Attorney, Agent, or Firm*—Alexander J. McKillop; Malcolm D. Keen; Richard D. Stone

[57] ABSTRACT

A process and apparatus for fluidized catalytic cracking of heavy oil feed using a plurality of feed nozzles. Flow through each nozzle is controlled based on distribution of feed, steam or catalyst in the reactor, as determined by a scanner such as a rotating gamma ray source and detector. More uniform contact of catalyst and feed improves conversion.

12 Claims, 3 Drawing Sheets

FCC PROCESS WITH SCANNED RISER

FIELD OF THE INVENTION

This invention relates to fluid catalytic cracking.

BACKGROUND OF THE INVENTION

Many refineries devote extraordinary amounts of energy and operating expense to convert most of a whole crude oil feed into high octane gasoline. The crude is fractionated to produce a virgin naphtha fraction which is usually reformed, and a gas oil and/or vacuum gas oil fraction which is catalytically cracked to produce naphtha, and light olefins. The naphtha is added to the refiners gasoline blending pool, while the light olefins are converted, usually by HF or sulfuric acid alkylation, into gasoline boiling range material which is then added to the gasoline blending pool.

The fluid catalytic cracking (FCC) process is the preferred process in the petroleum refining industry for converting higher boiling petroleum fractions into lower boiling products, especially gasoline. In FCC, a finely divided solid cracking catalyst promotes cracking reactions. The catalyst is in a finely divided form, typically with particles of 20–100 microns, with an average of about 60–75 microns. The catalyst acts like a fluid (hence the designation FCC) and circulates in a closed cycle between a cracking zone and a separate regeneration zone.

Fresh feed contacts hot catalyst from the regenerator in the base of a riser reactor. There are many localized catalyst currents and eddies, and many refiners now start the catalyst flowing smoothly up the riser by injecting some sort of lift gas. The cracked products are discharged from the riser, separated, and cracking reactor sent to a main fractionator which produces several product streams.

A further description of the catalytic cracking process may be found in the monograph, "Fluid Catalytic Cracking With Zeolite Catalysts", Venuto and Habib, Marcel Dekker, N.Y., 1978, incorporated by reference.

One of the most complex, and least understood parts of the FCC process is where catalyst contacts feed in the base of the riser. Much effort has been spent developing better FCC nozzles to achieve a more uniform spray pattern into the riser), riser base designs to promote catalyst mixing, or multi-nozzle control schemes.

U.S. Pat. No. 5,108,583 is one of many FCC feed nozzle patents, and is incorporated herein by reference.

U.S. Pat. Nos. 4,717,467 and 4,578,183 which are incorporated by reference, are directed to modifying the riser base to make better use of feed nozzles. A venturi section, or draft tube is used to promote better contact of feed and hot catalyst.

These approaches, better nozzles, different riser configurations, have never been as successful as desired, due in part to the nature of the FCC process. Change is constant in FCC, due to changes in feed rate and type, and catalyst circulation. Feed nozzles plug, valves erode, and flow patterns in the base of the riser may change constantly.

U.S. Pat. Nos. 4,808,383, Buyan, incorporated by reference, recognized the difficulty of achieving the perfect nozzle, or the perfect riser base shape for perfect contacting, and resorted to individual control of multiple nozzles, with the nozzle flow control valves driven by taking a temperature profile across the riser.

While such an approach works, it requires the insertion of a probe through a packing gland in a purge nozzle in the riser. Because of harsh conditions in the riser it is not practical to leave thermocouples permanently installed in the riser, and not safe to make frequent temperature profiles through packing glands providing access to the riser. It was best suited to a one time probe, of a line across one elevation of a riser.

I wanted an approach with more depth to it. I wanted the benefits of the '383 approach to improving catalyst:oil mixing in the base of a riser, but without the '383 limitations.

I realized that it was possible to use a non-intrusive method of measuring the riser density in a plane across the riser, at one (or even multiple) elevations in the riser. I developed a way to make continuous, non-intrusive, measurements of density in the riser, and use this information to control directly the flow of feed to individual nozzles.

BRIEF SUMMARY OF THE INVENTION

Accordingly, the present invention provides a process for the fluidized catalytic cracking of a hydrocarbon feed oil containing hydrocarbons boiling above 650° F. to catalytically cracked products comprising: charging a stream of regenerated catalyst to a base portion of a vertically disposed elongated tubular conduit riser reactor, said base in a lower half of said riser reactor and a riser outlet in an upper half of said riser reactor, to form an upflowing stream of regenerated catalyst which is not uniformly distributed about a cross section of said riser reactor; charging oil feed and atomizing vapor into a plurality of feed nozzles disposed in said lower half of said conduit to form a mixture of non-uniformly distributed catalyst and oil feed in said lower half of said riser reactor; non-invasively scanning at at least one vertical elevation of said riser reactor to determine the distribution of at least one of the group of feed, catalyst and atomizing vapor at a cross section of said riser; controlling independently, and at least intermittently, the flow rate of at least one of said oil feed and atomizing vapor into at least some of said plurality of feed nozzles in response to said scanning to distribute said oil feed across said cross section of said riser to match the distribution of catalyst; cracking said mixture of feed and catalyst in said riser reactor to produce a mixture of cracked products and spent catalyst which are discharged from a top portion of said riser reactor; separating said mixture to produce a stream of catalytically cracked products which are removed as a product and spent catalyst containing entrained and absorbed cracked products and coke; stripping said spent catalyst in a stripping means by contact with a stripping gas at stripping conditions to produce stripped catalyst; regenerating said stripped catalyst in a catalyst regeneration means at regeneration conditions including contact with an oxygen containing gas to produce regenerated catalyst; and recycling said regenerated catalyst to said base portion of said riser reactor.

In an apparatus embodiment, the present invention provides an apparatus for feeding oil, atomizing vapor and catalyst to a fluidized catalytic cracking tubular reactor comprising: a tubular reactor formed as a vertically or horizontally disposed elongated tubular conduit having an upstream end and a downstream end, said downstream end feeding into a cracked product and spent catalyst separation means in a vessel; a plurality of feed nozzles spaced about a lower portion of said tubular reactor; means for non-invasively scanning at at least one vertical elevation of said tubular reactor to determine the distribution of at least one of oil, atomizing vapor and catalyst and create a distribution signal; and means for independent control of the flow rate of at least one of oil feed and atomizing vapor into at least some of said plurality of feed nozzles, said independent flow control means controlled by said distribution signal.

DETAILED DESCRIPTION OF PREFERRED EMBODIMENTS

Figure 1:
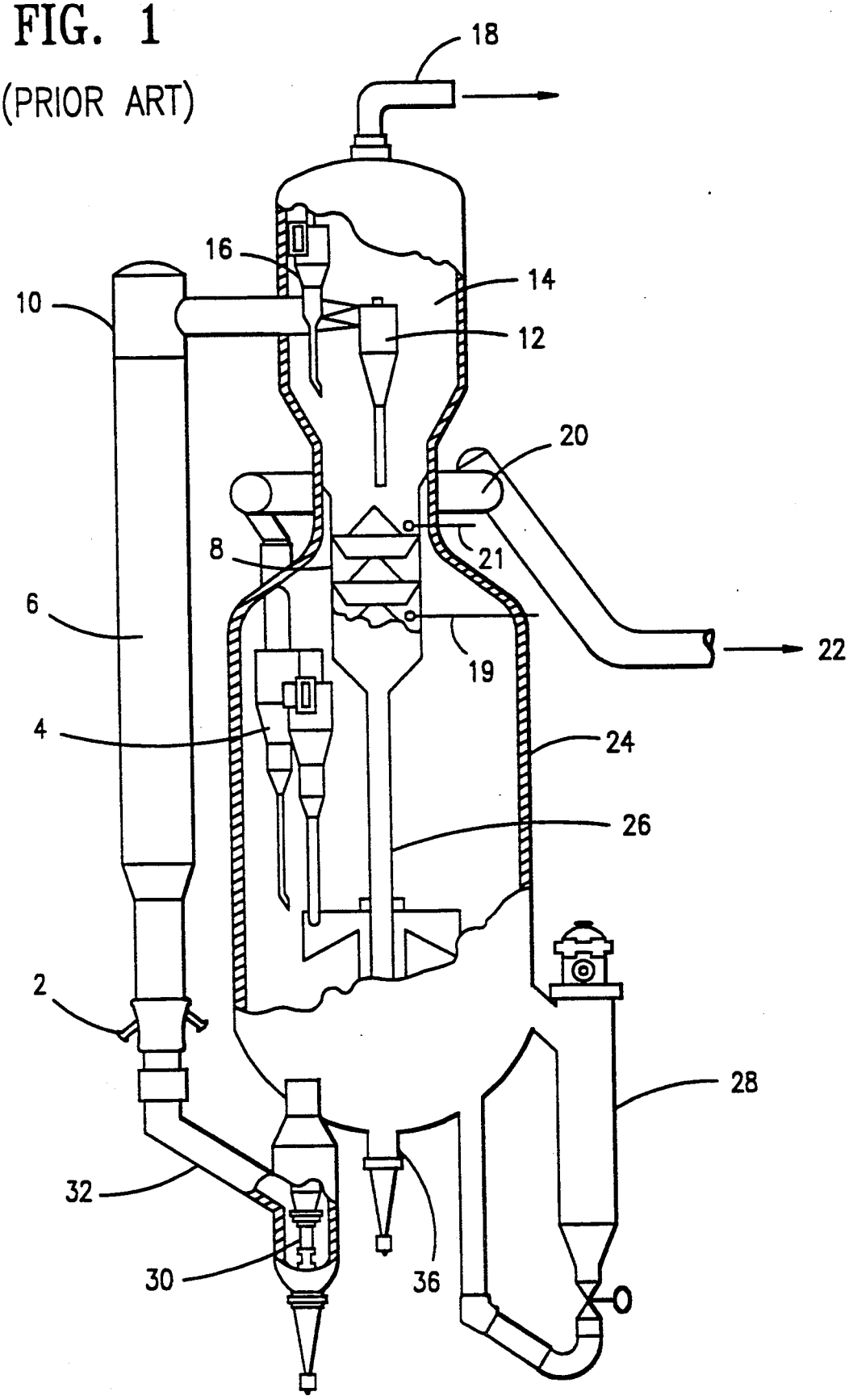
FIG. 1 (PRIOR ART)
FIG. 1 (Prior Art) shows a conventional FCC unit with a riser reactor.

FIG. 1 (Prior Art) is a simplified schematic view of an FCC unit of the prior art, similar to the Kellogg Ultra Orthoflow converter Model F shown as FIG. 17 of Fluid Catalytic Cracking Report, in the Jan. 8, 1990 Oil & Gas Journal.

A heavy feed such as a gas oil, vacuum gas oil is added to riser reactor 6 via feed injection nozzles 2. The cracking reaction is completed in the riser reactor, which takes a 90° turn at the top of the reactor at elbow 10. Spent catalyst and cracked products discharged from the riser reactor pass through riser cyclones 12 which efficiently separate most of the spent catalyst from cracked product. Cracked product is discharged into disengager 14, and eventually is removed via upper cyclones 16 and conduit 18 to the fractionator.

Spent catalyst is discharged down from a dipleg of riser cyclones 12 into catalyst stripper 8, where one, or preferably 2 or more, stages of steam stripping occur, with stripping steam admitted via lines 19 and 21. The stripped hydrocarbons, and stripping steam, pass into disengager 14 and are removed with cracked products after passage through upper cyclones 16.

Stripped catalyst is discharged down via spent catalyst standpipe 26 into catalyst regenerator 24. The flow of catalyst is controlled with spent catalyst plug valve 36.

This type of stripper design is one of the most efficient in modern FCC units, due in large part to its generous size. Most riser reactor FCCs have strippers as annular beds about the riser reactor, and do not provide as much cross sectional area for catalyst flow as does the design shown in FIG. 1.

Catalyst is regenerated in regenerator 24 by contact with air, added via air lines and an air grid distributor not shown. A catalyst cooler 28 is provided so heat may be removed from the regenerator, if desired. Regenerated catalyst is withdrawn from the regenerator via regenerated catalyst plug valve assembly 30 and discharged via lateral 32 into the base of the riser reactor 6 to contact and crack fresh feed injected via injectors 2, as previously discussed. Flue gas, and some entrained catalyst, are discharged into a dilute phase region in the upper portion of regenerator 24. Entrained catalyst is separated from flue gas in multiple stages of cyclones 4, and discharged via outlets 8 into plenum 20 for discharge to the flare via line 22.

Figure 2B:
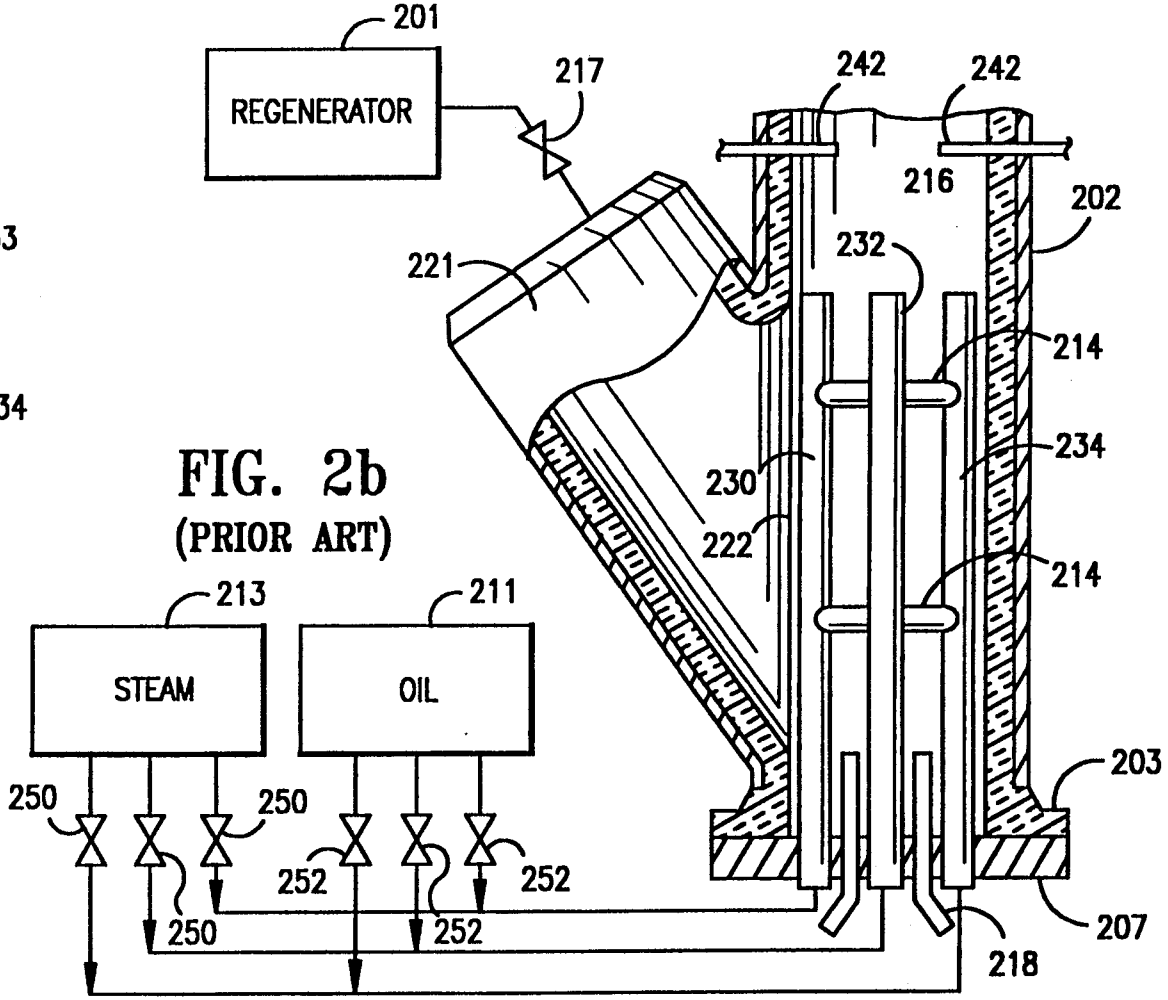
FIG. 2b (PRIOR ART)
FIGS. 2*a* and 2*b* (Prior Art) are from U.S. Pat. No. 4,808,383, and show individually controlled feed nozzles in a riser reactor with a thermocouple probe.
Figure 2A:
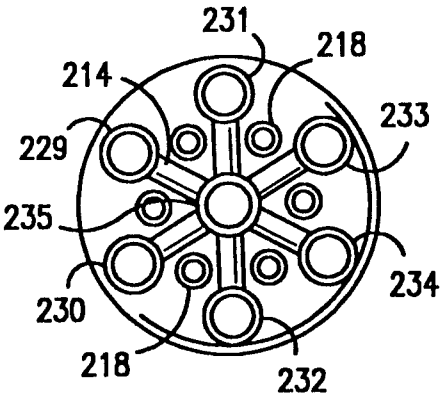
FIG. 2a (PRIOR ART)

FIGS. 2*a* and 2*b* (Prior Art) are from U.S. Pat. No. 4,808,383, and show individually controlled feed nozzles in a riser reactor 202 with a thermocouple probe 242.

A riser 202 lined with insulation 216 has in a base portion vertical nozzles 229–235. Line 218 in an emergency steam line. Braces 214 help support the nozzles. The nozzles extend through a flange 207 which is attached to riser flange 203. Catalyst flows from the regenerator 201, shown as a box, through slide valve 217 into conduit 221 into catalyst port 222. Steam from line 213 passes through individual lines to each of the nozzles 229–235. An oil header 211 provides oil to each line to each nozzle. For clarity, only nozzles 230, 232 and 234 are shown in FIG. 2*b*, but the other nozzles are there. Each oil and steam line has its own valve 250 or 252 respectively to permit individual control of steam and oil flow into each nozzle 229–235.

Three thermocouples 242 (only two are shown) are located in the riser on the same horizontal plane above the nozzles 231–235. These were located 7 feet above the nozzle outlets. The thermocouples are supported by rods passing through the reactor wall, so that the temperature can be measured at various points along the diameter.

Figure 4:
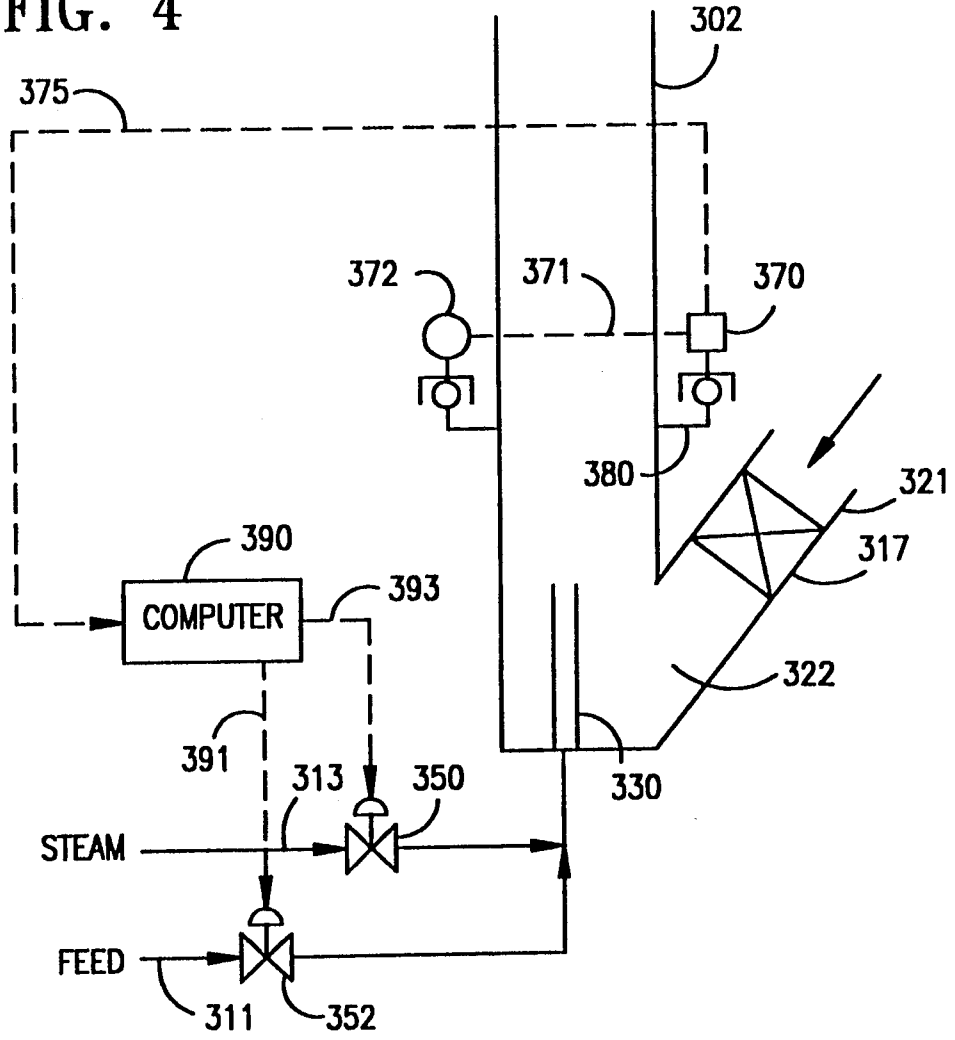
FIG. 4 (Invention) shows one type of scan for a riser.

FIG. 4 (Invention) shows a simplified view of a preferred arrangement of feed nozzles controlled by a movable non-invasive flow probe.

Regenerated catalyst passes via conduit 321 and slide valve 317 into catalyst port 322. Steam from line 313 and oil feed in line 311 pass into the base of a nozzle 330. For clarity, only a single nozzle is shown though in practice 6 or more nozzles are preferred. Atomized feed is discharged from the nozzles 330 to mix with catalyst in the base of the riser 302 and begin passage up the riser. At a higher elevation in the riser are a rotatably mounted gamma ray source 372 and detector 370. A scanned region is indicated by dotted line 371. A signal is sent from the detector via signal line 375 to computer 390. Signals are preferably sent continuously, or at frequent intervals, as the radiation source and detector rotate on track or radially rotatable support means 380.

Computer 390, which may be an analog or preferably a digital computer, calculates a catalyst density, a steam distribution, or some other riser property of interest, and sends a plurality of signals to oil feed nozzles via line 391 which controls valve 352. In the device shown it is possible to individually control not only oil flow to each valve, but also steam flow to each valve via control signal 393 to a plurality of steam valves 350 on steam lines 313.

In some installations the computer 390 will send a signal to the oil line only and both oil and steam flow then adjusted proportionally. Phrased another way, the computer may reset the oil flow control valve, and the oil flow valve may drive the steam flow or pressure control valve.

Figure 3:
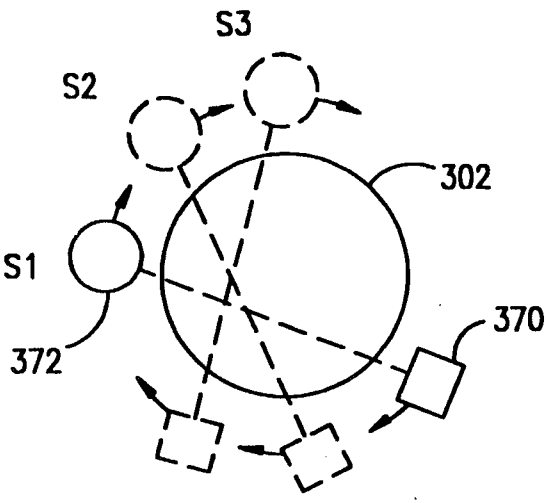
FIG. 3 (Invention) shows a simplified view of a preferred arrangement of feed nozzles controlled by a movable non-invasive flow probe.

FIG. 3 (Invention) shows a part of a preferred scan for a riser reactor. Riser 302 is scanned first in position 1, shown as S1, with source 372 and detector 370 as shown. The second scan is at position S2, and the third at S3.

Although continuous scanning of the entire cross section of a riser is preferred, it will be possible to improve riser operation with something less than this, i.e., to scan only ½ of the riser. Most risers of the type shown in FIG. 2*b*, with a Y catalyst feed, and without a lift gas, will have serious problems of catalyst mal-distribution, but there is usually left-right symmetry about the plane encompassing the vertical riser axis and the centerline of the regenerated catalyst return line 221.

It will also be acceptable in many installations to scan only 2–3 times each 8 hour period, or even once a day.

Having provided an overview of the process and apparatus of the invention, more details will now be provided about the FCC process and the radiation source and detector.

CRACKING CATALYST

Conventional cracking catalysts may be used. It is preferred to use a highly active cracking catalyst. The catalyst zeolite content, as measured by the large pore, or Y zeolite content, of the makeup catalyst, should be at least 15 wt %, and more preferably at least 25 wt % or higher.

CRACKING REACTOR

A conventional riser cracking reactor can be used. The process is also applicable to downflow cracking reactors, which do not have as severe catalyst distribution problems as riser reactors.

FEED NOZZLES

Conventional feed nozzles can be used. My process (and all FCC units) works best if the nozzles develop a uniform spray of fine droplets, but such operation is rarely achieved for long periods. Good nozzles are available from Bete Fog or the M. W. Kellogg Engineering Company, as examples.

All FCC feed nozzles operate with some sort of atomizing vapor, usually steam. Conventional amounts of atomizing steam may be used, typically 1 to 5 wt % of feed, but for very heavy feeds some units may use more steam than this.

REACTOR CONDITIONS

The process uses conventional riser cracking conditions. These include a riser top temperature of 950° to 1200° F., preferably 975° to 1050° F., a pressure of atmospheric to 50 psig, and a cat:oil weight ratio of from about 1:1 to 20:1, preferably from 3:1 to 6:1. The feed is usually preheated to 350° to 700° F., though some may operate with feed preheat outside of this range.

CATALYST STRIPPING/REGENERATION

Catalyst stripping and regeneration may be conventional. Catalyst is usually stripped with steam, and the resulting stripped catalyst regenerated by contact with an oxygen containing gas in the regenerator.

RADIATION SOURCE AND DETECTOR

The process works best when a continuous scanner is used to develop a signal indicative of catalyst density, and/or perhaps oil density, through at least a line section of the riser, and preferably across a planar cross section, and most preferably in a volume of the riser reactor. In most units, a planar cross section will greatly improve riser operation, and be relatively inexpensive to install.

Such scanning techniques are actually quite old in the FCC arts with detailed reviews of equipment and procedure appearing more than 4 decades ago. Bartholomew and Casagrande, Measuring Solids Concentration in Fluidized Systems by Gamma-Ray Absorption, *Industrial and Engineering Chemistry*, Vol 49, No. 3, March 1957, pp 428–431, disclosed the procedure, and had examples, for determining catalyst density in a 20.4 inch riser reactor. This article is incorporated by reference.

A commercially available movable gamma ray scanner such as that shown in FIG. 4 is available from Tru-Tec Division, Koch Engineering Company Inc.

Alternatively, and not necessarily with equivalent results, other radiations sources and detectors, and calculation methods may be used.

An X-ray scanner may be used, if a sufficiently strong X-ray source is used to penetrate the walls of the riser reactor. Alternatively a section may be provided in the riser reactor of a material relatively transparent to X-rays, or multiple ports of an X-ray transparent material may be provided.

Other types of non-invasive scanning now commercially available, or hereafter developed may be used. There has been an explosion in CAT scanning equipment and calculation methods, from different radiation sources to computational techniques which allow real time imaging of life processes. Much of the hardware and computational techniques can be used herein, but the benefits of using, e.g., positron emissions will not usually be worth the cost. Rather than use exotic radiation sources, conventional sources, such as microwaves, have some advantages.

Microwaves may be tuned to ignore FCC catalyst. Commercial home use microwaves are tuned to excite water molecules and ignore ceramics, glass etc. Microwaves are less hazardous to workers than many types of radiation, and are readily contained by metal shielding. Finally, microwaves may be conveyed by ductwork, so it is possible to provide only one or two openings in the riser for a microwave source and "pipe" or distribute the microwaves to a plurality of outlets within the metal walls of the riser to produce 10 or 20 microwave outlets radially distributed, and even vertically distributed, about the riser.

U.S. Pat. No. 5,073,349, which is incorporated by reference, provides more details on ways to get microwaves past metal and into an FCC unit. This reference taught use of a microwave heated catalyst stripper, with microwaves tuned to ignore catalyst and heat oil. A similar tuned approach may be used herein.

Conventional calculation techniques, similar to those used in commercial CAT devices may be used to calculate catalyst and/or oil densities in the riser.

It is not essential that the source and detector move (as shown in the Figure). It is satisfactory to provide multiple sources and multiple detectors to simulate motion of a source and detector.

It will usually be necessary to use a digital computer to process the signals, although analogue computers could be used. What is essential is to have some means of determining a density of some substance in the riser and have this derived density drive at least some of the oil feed nozzle flow controllers to permit continuous fine tuning of oil feed to various places in the riser reactor.

Preferably the riser volume, or a cross section of the riser within 0–3 inner diameters of the feed nozzle outlets, is scanned. Sometimes it will be preferred to scan before good mixing is achieved, so flow problems can be more accurately detected and corrected. If a nozzle plugs or an orifice tip erodes away it will be easiest to locate the errant nozzle by scanning near the nozzle outlet. There also may be benefits to feed forward control, measuring catalyst flows approaching each nozzle, and adjusting the flow of oil to each nozzle so enough oil will be sent to mix with the projected amount of catalyst.

I claim:

1. A process for fluidized catalytic cracking of a hydrocarbon oil feed containing hydrocarbons boiling above 650° F. to catalytically cracked products comprising:

a) charging a stream of regenerated catalyst to a base portion of a vertically disposed elongated tubular conduit riser reactor, said base in a lower half of said riser reactor and a riser outlet in an upper half of said riser reactor, to form an upflowing stream of regenerated catalyst, and wherein said regenerated catalyst is not uniformly distributed about a cross section of said riser reactor;

b) charging oil feed and atomizing vapor into a plurality of feed nozzles disposed in said lower half of said conduit to form a mixture of non-uniformly distributed catalyst and oil feed in said lower half of said riser reactor;

c) non-invasively scanning at at least one vertical elevation of said riser reactor to determine the distribution of at least one of the group consisting of oil feed, and atomizing vapor at a cross section of said riser;

d) controlling independently, and at least intermittently, the flow rate of at least one of said oil feed and atomizing vapor into at least some of said plurality of feed nozzles in response to said scanning to distribute said oil feed across said cross section of said riser to match the distribution of catalyst;

e) cracking said mixture of feed and catalyst in said riser reactor to produce a mixture of cracked products and spent catalyst which are discharged from a top portion of said riser reactor;

f) separating said mixture to produce a stream of catalytically cracked products which are removed as a product and a stream of spent catalyst containing entrained and absorbed catalytically cracked products and coke;

g) stripping said spent catalyst in a stripping means by contact with a stripping gas at stripping conditions to produce stripped catalyst;

h) regenerating said stripped catalyst in a catalyst regeneration means at catalyst regeneration conditions including contact with an oxygen containing gas to produce regenerated catalyst; and i) recycling said regenerated catalyst to said base portion of said riser reactor.

2. The process of claim 1 wherein said scanner comprises a gamma ray source and a gamma ray detector.

3. The process of claim 2 wherein the source and detector are rotatably connected perpendicular to the plane of the riser.

4. The process of claim 1 wherein said scanner comprises a microwave source and detector.

5. The process of claim 1 wherein said scanner is both rotatably connected perpendicular to the plane of the riser and able to travel up and down the axis of the riser to scan a three dimensional volume of said riser.

6. The process of claim 1 wherein said feed nozzles are continuously controlled by said scanning means.

7. The process of claim 1 wherein said riser has an inner diameter, and said scanning occurs within a vertical distance three inner diameters downstream of said feed nozzles.

8. The process of claim 1 wherein said riser has two sets of feed nozzles, a primary set of feed nozzles which spray a constant amount of feed into said riser and a secondary set of feed nozzles each of which is individually controlled by said scanning means.

9. The process of claim 1 wherein said scanning means controls both oil flow and atomizing vapor flow to each nozzle.

10. The process of claim 1 wherein said scanning means controls oil flow to each nozzle, and atomizing vapor flow is set by said oil flow.

11. The process of claim 1 wherein said atomizing vapor is steam.

12. The process of claim 1 wherein said scanning means uses a radiation source which ignores catalyst and is selective for at least one of steam and hydrocarbon oil feed.

* * * * *